US007263942B1

(12) United States Patent
Dobashi et al.

(10) Patent No.: US 7,263,942 B1
(45) Date of Patent: Sep. 4, 2007

(54) FIN STABILIZER FOR VESSEL AND CONTROL METHOD AND CONTROL PROGRAM THEREFOR

(75) Inventors: Shuji Dobashi, Nagasaki (JP); Katsuhide Matsunaga, Nagasaki (JP); Tatsunori Ogahara, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/494,483

(22) Filed: Jul. 28, 2006

(51) Int. Cl.
*B63B 39/00* (2006.01)

(52) U.S. Cl. ..... 114/122; 114/126

(58) Field of Classification Search ..... 114/122, 114/121, 126; 701/21
See application file for complete search history.

(56) References Cited

U.S. PATENT DOCUMENTS

| | | | | |
|---|---|---|---|---|
| 3,611,971 | A * | 10/1971 | Gwynn et al. | 114/126 |
| 4,023,516 | A * | 5/1977 | Bennett | 114/126 |
| 4,200,168 | A * | 4/1980 | Moog | 180/282 |
| 4,380,206 | A * | 4/1983 | Baitis et al. | 114/122 |
| 5,511,504 | A | 4/1996 | Martin | |

FOREIGN PATENT DOCUMENTS

| | | |
|---|---|---|
| JP | 61-160389 | 7/1986 |
| JP | 6-23519 | 6/1994 |
| JP | 08-324485 | 12/1996 |
| JP | 2915658 | 4/1999 |

* cited by examiner

*Primary Examiner*—Ed Swinehart
(74) *Attorney, Agent, or Firm*—Wenderoth, Lind & Ponack, L.L.P.

(57) ABSTRACT

An object is to suppress the rocking motion of a vessel body with a high level of accuracy by obtaining a required lifting force. A torque calculation section 27 calculates a torque of a fin 11 based on the pressure of a hydraulic cylinder 12. This torque is inputted to an angle of attack computing unit 24 via a torque adjusting unit 28, and based on this torque, a fin angle with respect to a flow of sea water, that is, an angle of attack of the fin is estimated. Then a command generation section 23 generates a fin angle command value θ3 for matching the estimated angle of attack θ2' with a target fin angle θ1. Based on this fin angle command value θ3, a flow rate adjusting mechanism 14 controls a flow rate Q of hydraulic fluid applied to the hydraulic cylinder 12, to thereby adjust the angle of the fin 11. Thus, the fin angle is controlled based on the angle of attack, which directly relates to lifting force.

6 Claims, 6 Drawing Sheets

FIN STABILIZER FOR VESSEL AND CONTROL METHOD AND CONTROL PROGRAM THEREFOR

BACKGROUND OF THE INVENTION

1. Field of the Invention

The present invention relates to a fin stabilizer for a vessel for suppressing a rocking motion of the vessel body.

This application is based on Japanese Patent Application No. 2005-118421, the content of which is incorporated herein by reference.

2. Description of Related Art

Conventionally, as an apparatus for suppressing the rolling motion and pitching motion of a vessel body there is known, for example, a fin stabilizer (for example, refer to Japanese Unexamined Patent Application, First Publication No. H08-324485). This fin stabilizer has a fin provided on and projecting from an outer panel of the vessel and by controlling an angle of this fin a lifting force is generated to suppress the rolling motion of the vessel body.

In such a fin stabilizer, a fin angle with respect to sea water flow (hereunder referred to as "angle of attack") and a fin angle with respect to the vessel body (hereunder referred to as "fin angle") are treated as identical, and anti-rolling control for the vessel is carried out by controlling the fin angle based on the rocking motion of the vessel body.

However, under the influence of wave disturbance and motion of the vessel body, the above angle of attack and fin angle may not match in some cases. In this case, in the above mentioned conventional fin stabilizer, there has been a problem in that the fin angle cannot be controlled at an appropriate angle and a required lifting force for suppressing rocking motion of the vessel body cannot be achieved.

BRIEF SUMMARY OF THE INVENTION

An object of the present invention is to provide a fin stabilizer for a vessel that can suppress the rocking motion of a vessel body with a high level of accuracy by obtaining a required lifting force, and a control method and control program therefor.

A first aspect of the present invention is a fin stabilizer for a vessel comprising a fin attached to a vessel body for reducing a rocking motion of the vessel body, and a fin driving device having a hydraulic cylinder for adjusting an angle of the fin with respect to the vessel body, wherein the fin stabilizer comprises: a pressure detection section that detects a pressure in the hydraulic cylinder; a torque calculation section that calculates a torque of the fin; a fin angle estimation section that estimates an angle of the fin with respect to a flow of sea water based on the calculated torque; and a command generation section that generates a fin angle command value for matching the estimated fin angle with a target angle for counteracting the rocking motion of the vessel body, and the fin driving device drives the fin based on the fin angle command value.

According to this aspect, the torque calculation section calculates a fin torque based on the pressure of the hydraulic cylinder, and the fin angle estimation section estimates a fin angle with respect to the flow of sea water, that is, an angle of attack, based on the torque. Moreover, the command generation section generates a fin angle command value for matching this angle of attack with the target angle, and the fin driving device drives the fin based on this fin angle command value. Thus, by controlling the fin angle based on the angle of attack, which directly relates to a lifting force, it becomes possible to attain the required lifting force, and the accuracy of the anti-rolling control can be improved.

Here, there is a correlation between the lifting force that acts on the fin and the fin torque. Furthermore, there is a correlation between the pressure of the hydraulic cylinder and the fin torque. Therefore, the fin torque can be obtained from the pressure of the hydraulic cylinder, and the lifting force that acts on the fin can be obtained from this torque. Moreover, since the lifting force that acts on the fin is determined by the angle of attack of the fin, the angle of attack of the fin can be estimated from the fin torque.

The fin stabilizer for a vessel may be further comprise a fin angle detection section that detects an angle of the fin with respect to the vessel body, and in the case where a rocking motion cycle of the vessel body is less than or equal to a preset predetermined threshold value, the command generation section may generate a fin angle command value for matching the fin angle detected by the fin angle detection section with the target angle.

In the case where the rocking motion cycle is less than or equal to a predetermined cycle, it is possible that torque calculation accuracy may decline due to a reduction in accuracy of the pressure detection carried out by the pressure detection section, in turn resulting in a reduction in reliability of the fin angle estimated by the fin angle estimation section. In such cases, anti-rolling control is carried out based on the fin angle with respect to the vessel body to maintain the level of accuracy substantially equal to that of the conventional fin stabilizer.

In the fin stabilizer for a vessel, the pressure detection section may comprise: a pressure sensor that respectively detects pressures in an upper cylinder chamber and a lower cylinder chamber of the hydraulic cylinder; and a noise removal section that removes a noise component contained in a detection value detected by the pressure sensor, and the predetermined threshold value may be determined based on the performance of the noise removal section.

The performance of the noise removal section changes depending on the rocking motion cycle. Therefore, within a range where the performance of the noise removal section is reduced, that is, at the time of a rocking motion cycle within which a required pressure detection accuracy cannot be maintained, anti-rolling control is carried out based on the fin angle with respect to the vessel body.

The above fin stabilizer for a vessel may further comprise: a fin angle detection section that detects an angle of the fin with respect to the vessel body; and a difference calculation section that finds a difference between an angle of the fin with respect to a sea water flow estimated by the fin angle estimation section and an angle of the fin with respect to the vessel body detected by the fin angle detection section, and in a case where the difference is greater than or equal to a preset predetermined value, the command generation section may generate a fin angle command value for matching the fin angle with respect to the vessel body detected by the fin angle detection section, with the target angle.

According to the above configuration, the difference calculation section finds the difference between the angle of the fin detected by the fin angle detection section, that is, the fin angle, and the angle of the fin estimated by the fin angle estimation section, that is, the angle of attack, and, in the case where this difference is greater than or equal to the preset predetermined value, the command generation section generates a fin angle command value based on the above fin angle. Thus, in the case where the fin angle and the angle of attack both have significant errors, control is stabilized by carrying out fin control based on the fin angle and not on the angle of attack.

A second aspect of the present invention is a control method for a fin stabilizer for a vessel that comprises a fin attached to a vessel body for reducing a rocking motion of the vessel body, and a fin driving device having a hydraulic cylinder for adjusting an angle of the fin with respect to the vessel body, wherein the control method comprises: a step for calculating a torque of the fin based on a pressure of the hydraulic cylinder; a step for estimating an angle of the fin with respect to a flow of sea water based on the calculated torque; a step for generating a fin angle command value for matching the estimated fin angle with a target angle for counteracting the rocking motion of the vessel body; and a step for controlling the fin driving device based on the fin angle command value.

According to the above control method, the fin torque is calculated based on the pressure of the hydraulic cylinder, and the fin angle with respect to the sea water flow, that is, the angle of attack directly relating to a lifting force, is estimated based on this calculated torque. Moreover, a fin angle command value for matching this angle of attack with the target angle is generated, and the fin driving device drives the fin based on this fin angle command value. As a result, the required lifting force can be obtained, and the accuracy of anti-rolling control can be improved.

A third aspect of the present invention is a control program for a fin stabilizer for a vessel that comprises a fin attached to a vessel body for reducing a rocking motion of the vessel body, and a fin driving device having a hydraulic cylinder for adjusting an angle of the fin with respect to the vessel body, for executing on a computer: a step for calculating a torque of the fin based on a pressure of the hydraulic cylinder; a step for estimating an angle of the fin with respect to a flow of sea water based on the calculated torque; a step for generating a fin angle command value for matching the estimated fin angle with a target angle for counteracting the rocking motion of the vessel body; and a step for controlling the fin driving device based on the fin angle command value.

By executing the above control program by a computer, the fin torque is calculated based on the pressure of the hydraulic cylinder, and the fin angle with respect to the sea water flow, that is, the angle of attack directly relating to a lifting force is estimated based on this calculated torque. Moreover, a fin angle command value for matching this angle of attack with the target angle is generated, and the fin driving device drives the fin based on this fin angle command value. As a result, the required lifting force can be obtained, and the accuracy of anti-rolling control can be improved.

According to the present invention, since it becomes possible to achieve the required lifting force, an effect can be achieved in which the rocking motion of the vessel body can be suppressed with a high level of accuracy.

DETAILED DESCRIPTION OF THE INVENTION

Hereinafter, embodiments of a fin stabilizer for a vessel according to the present invention are described, with reference to the drawings.

First Embodiment

Hereunder, a fin stabilizer for a vessel according to a first embodiment of the present invention is described.

Figure 1:
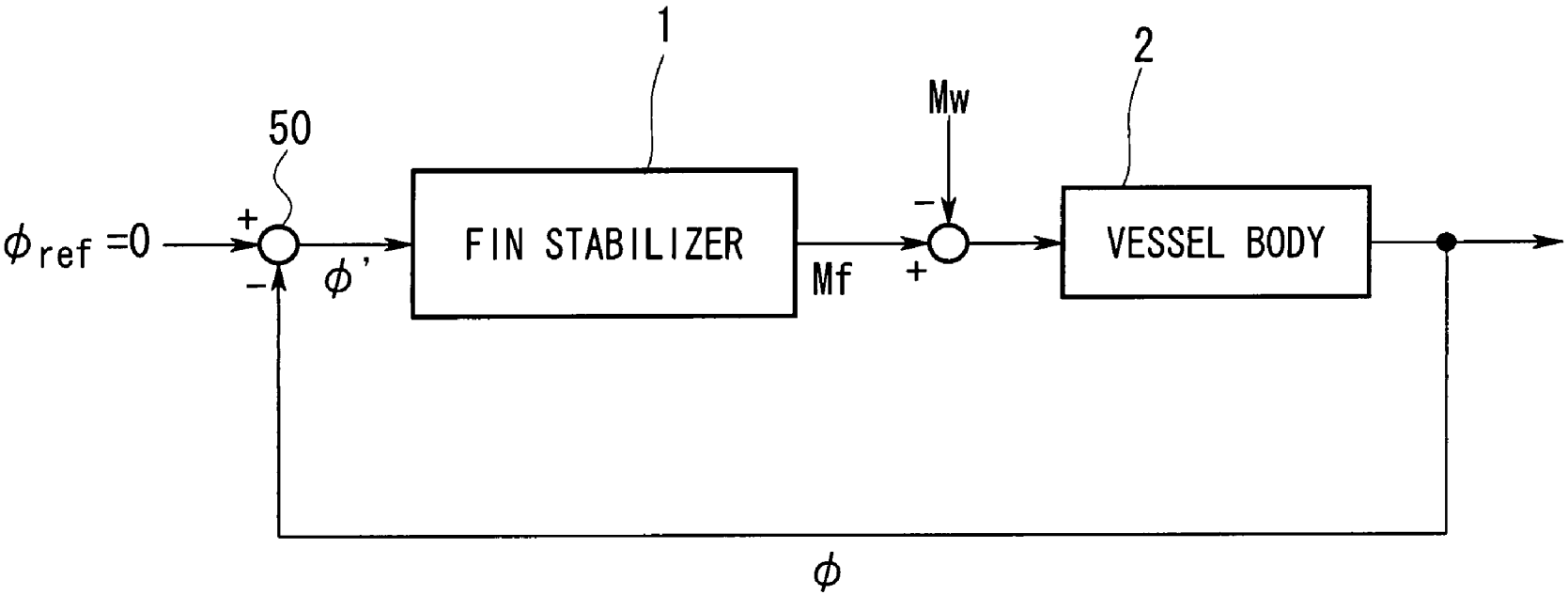
FIG. 1 is a control block diagram for explaining an effect of a fin stabilizer for a vessel according to a first embodiment of the present invention, on a vessel body.

FIG. 1 is a control block diagram for explaining an effect of a fin stabilizer for a vessel (hereunder referred to as "fin stabilizer") according to the present embodiment, on a vessel body.

As shown in this diagram, a sensor (not shown in the diagram) provided on a vessel body 2 detects an actual inclination angle $\phi$ of the vessel body 2 and enters it into a target inclination angle generation section 50. In the target inclination angle generation section 50, an inclination angle command value $\phi'$ for matching the actual inclination angle $\phi$ of the vessel body 2 to a target inclination angle $\phi ref$ (=0) is calculated, and this inclination angle command value $\phi'$ is outputted to a fin stabilizer 1. The target inclination angle generation section 50, for example, outputs a difference between the target inclination angle $\phi ref$ and the actual inclination angle $\phi$ of the vessel body 2 as the inclination angle command value $\phi'$. In the fin stabilizer 1, as described later, by controlling the angle of the fin based on the inclination angle command value $\phi'$, a lifting force, which makes the inclination angle of the vessel body 2 zero, is generated to suppress the rocking motion of the vessel body 2.

Figure 2:
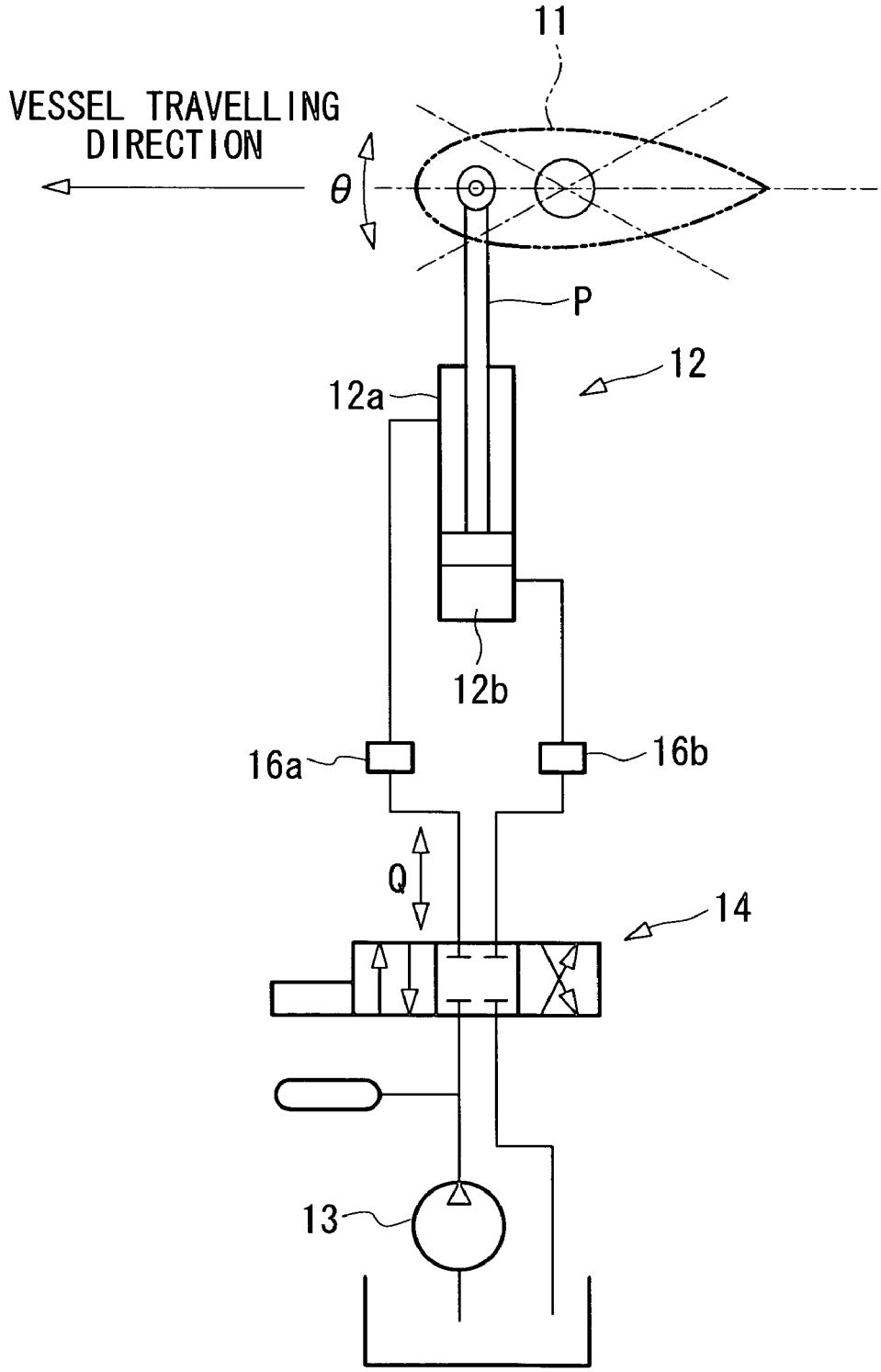
FIG. 2 is a diagram schematically showing a mechanical configuration of the fin stabilizer according to a first embodiment of the present invention.

In the above fin stabilizer 1, as shown in FIG. 2, a fin 11 is pivoted about a pivot axis by a hydraulic cylinder 12. This hydraulic cylinder 12 has a piston P. This piston P is configured to move in reciprocal motion within the hydraulic cylinder 12, based on a positive/negative direction flow and a flow rate Q of operating oil supplied from a constant discharge pump 13 via a flow rate adjusting mechanism 14 (provided for example with an electro-hydraulic servo valve). The flow rate Q of the discharged oil is adjusted by the flow rate adjusting mechanism 14.

According to such a configuration, when the flow rate Q is adjusted by the flow rate adjusting mechanism 14, the piston P of the hydraulic cylinder 12 moves in an up-down direction, and an angle θ of the fin 11 is adjusted to the required angle.

In an upper cylinder chamber 12*a* of the hydraulic cylinder 12, an upper side pressure sensor 16*a* is provided to detect the oil pressure inside the hydraulic cylinder. Similarly, in a lower cylinder chamber 12*b* of the hydraulic cylinder 12, a lower side pressure sensor 16*b* is provided to detect the oil pressure inside the hydraulic cylinder.

Figure 3:
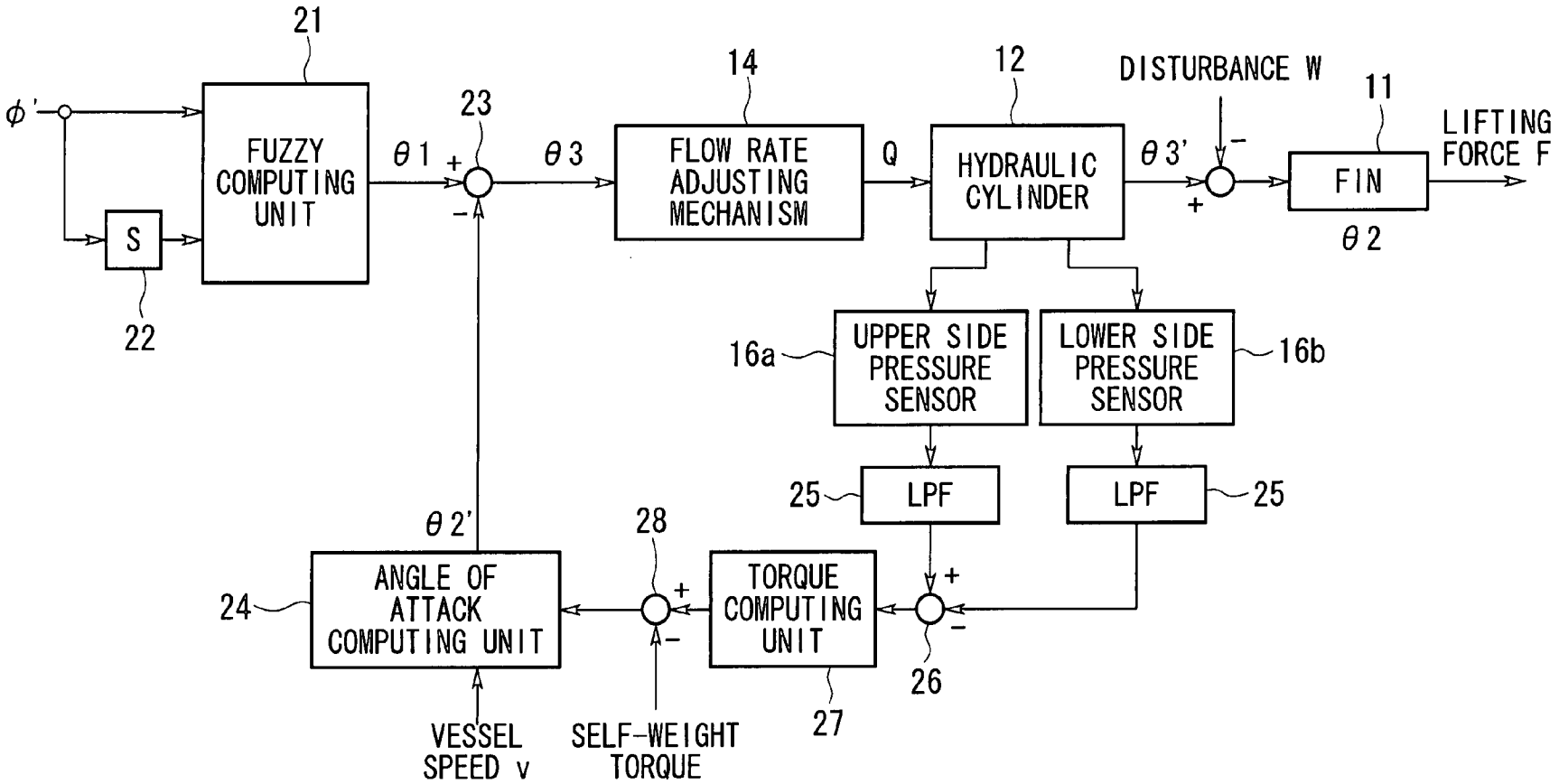
FIG. 3 is a block diagram showing a control system of a fin stabilizer according to the first embodiment of the present invention.

Next, a control system of the fin stabilizer according to the above described present embodiment is described with reference to FIG. 3. FIG. 3 is a block diagram showing a control system of a fin stabilizer according to the present embodiment. In FIG. 3, components the same as those shown in FIG. 2 mentioned above are denoted by the same reference symbols.

First, the inclination angle command value ϕ' shown in FIG. 1 is inputted to a fuzzy computing unit 21 and a differentiation unit 22 of the fin stabilizer 1 shown in FIG. 3. The differentiation unit 22 differentiates the inclination angle command value ϕ' and outputs this to the fuzzy computing unit 21. The fuzzy computing unit 21 finds the fin angle required to make the inclination angle ϕ of the vessel body 2 zero, and outputs this as a target fin angle θ1. For a computing procedure performed by the fuzzy computing unit 21, for example, the method disclosed in Japanese Patent No. 2915658 may be employed.

The target fin angle θ1 outputted from the fuzzy computing unit 21 is inputted to a command generation section 23. The command generation section 23 compares the above target fin angle θ1 with a fin angle of attack (hereunder, referred to as "estimated angle of attack"; angle of attack is the angle of the fin 11 with respect to sea water flow.) θ2' estimated by an angle of attack computing unit 24 described later, and finds a fin angle command value θ3 for matching the estimated angle of attack θ2' with the target fin angle θ1.

The fin angle command value θ3 found by the command generation section 23 is inputted to the flow rate adjusting mechanism 14. The flow rate adjusting mechanism 14 operates to supply operating oil to the hydraulic cylinder 12 at a flow rate Q corresponding to the fin angle command value θ3. Accordingly, the flow rate Q corresponding to the fin angle command value θ3 is supplied to the hydraulic cylinder 12, and an actual fin angle (hereunder referred to as "actual fin angle"; fin angle is the angle of the fin 11 with respect to the vessel body.) θ3' of the fin 11 changes. By changing the fin angle θ3' under the influence of a disturbance W or the like of the sea water, it becomes the fin angle with respect to sea water, that is, the actual fin angle of attack θ2. A lifting force acts according to this fin angle of attack θ2 and suppresses the rocking motion of the vessel body.

On the other hand, in order to feedback-control this actual fin angle of attack θ2, first, the upper side pressure sensor 16*a* detects the pressure in the upper side cylinder chamber of the hydraulic cylinder 12, and the lower side pressure sensor 16*b* detects the pressure in the lower side cylinder chamber. A higher harmonic wave (noise component) is removed from these detected values by respectively passing them through low-pass filters 25, and these detected values are inputted to a subtracter 26. The subtracter 26 computes a pressure difference between the upper and lower cylinder chambers of the hydraulic cylinder 12, and the pressure difference that results from this computation is inputted to a torque computing unit 27. The torque computing unit 27 calculates the torque acting on the fin 11 based on the pressure difference between the upper and lower cylinder chambers of the hydraulic cylinder 12, and outputs this calculated torque. A torque adjusting unit 28 subtracts a self-weight torque component, which is a torque based on a self-weight of the fin, from the torque computed by the torque computing unit 27, after which the result is inputted to the angle of attack computing unit 24.

The angle of attack computing unit 24 estimates the angle of attack θ2 of the fin 11 based on the torque inputted from the torque adjusting unit 28.

Figure 4:
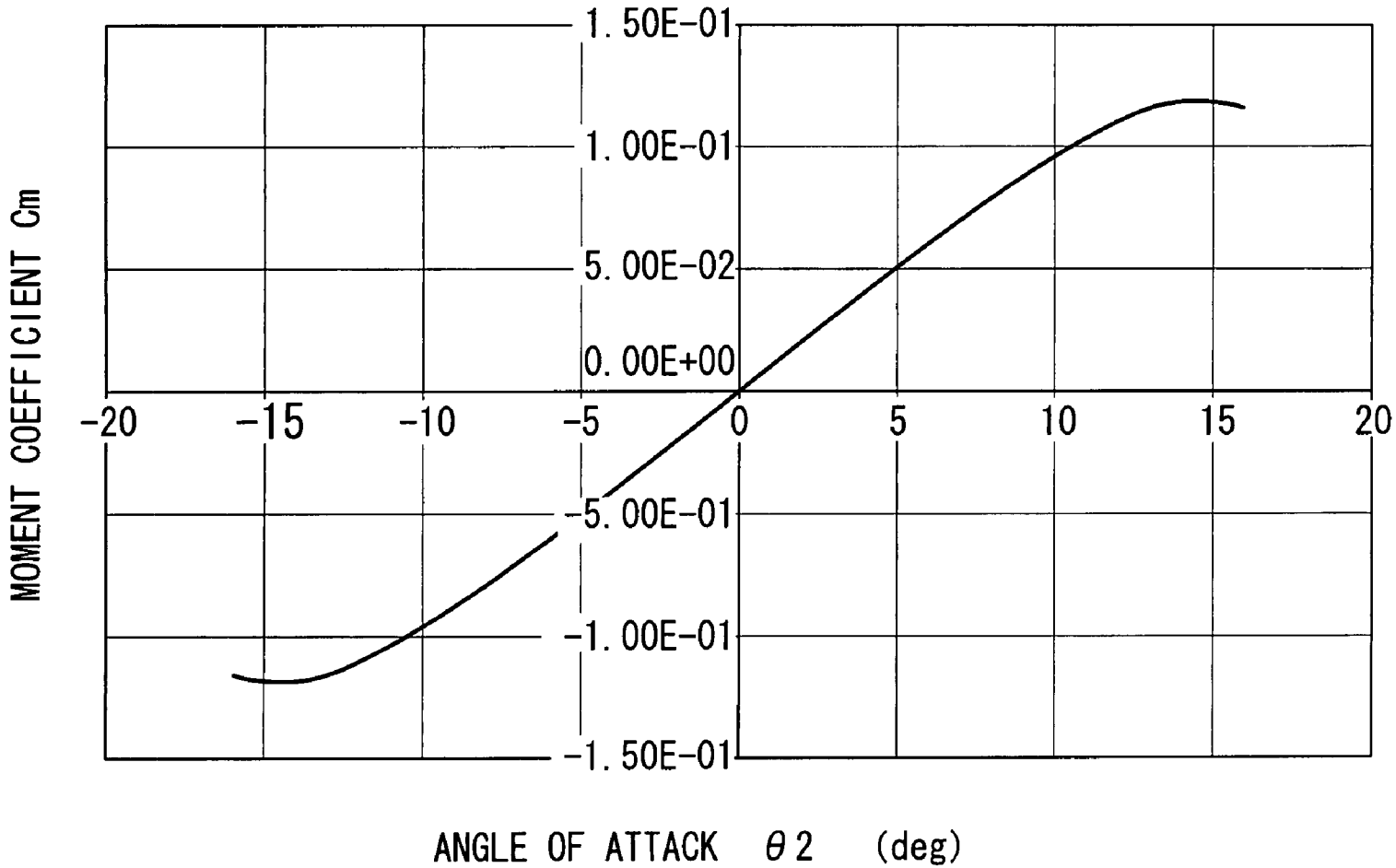
FIG. 4 is a diagram showing an example of a moment coefficient table illustrating a correlation between a moment coefficient Cm and an angle of attack θ2.

The angle of attack computing unit 24 has, for example, as shown in FIG. 4, a moment coefficient table for associating a moment coefficient Cm relating to a moment M which acts on the fin 11, with the angle of attack θ2. Here, since the relationship between the moment coefficient Cm and the angle of attack θ2 changes with a flow velocity v of the sea water, these associations are made according to the flow velocity v of sea water.

Here, the moment coefficient Cm can be obtained from the following expression (1).

$$Cm = \frac{M}{\frac{1}{2}\rho v^2 \mathrm{AC}} \tag{1}$$

Figure 5:
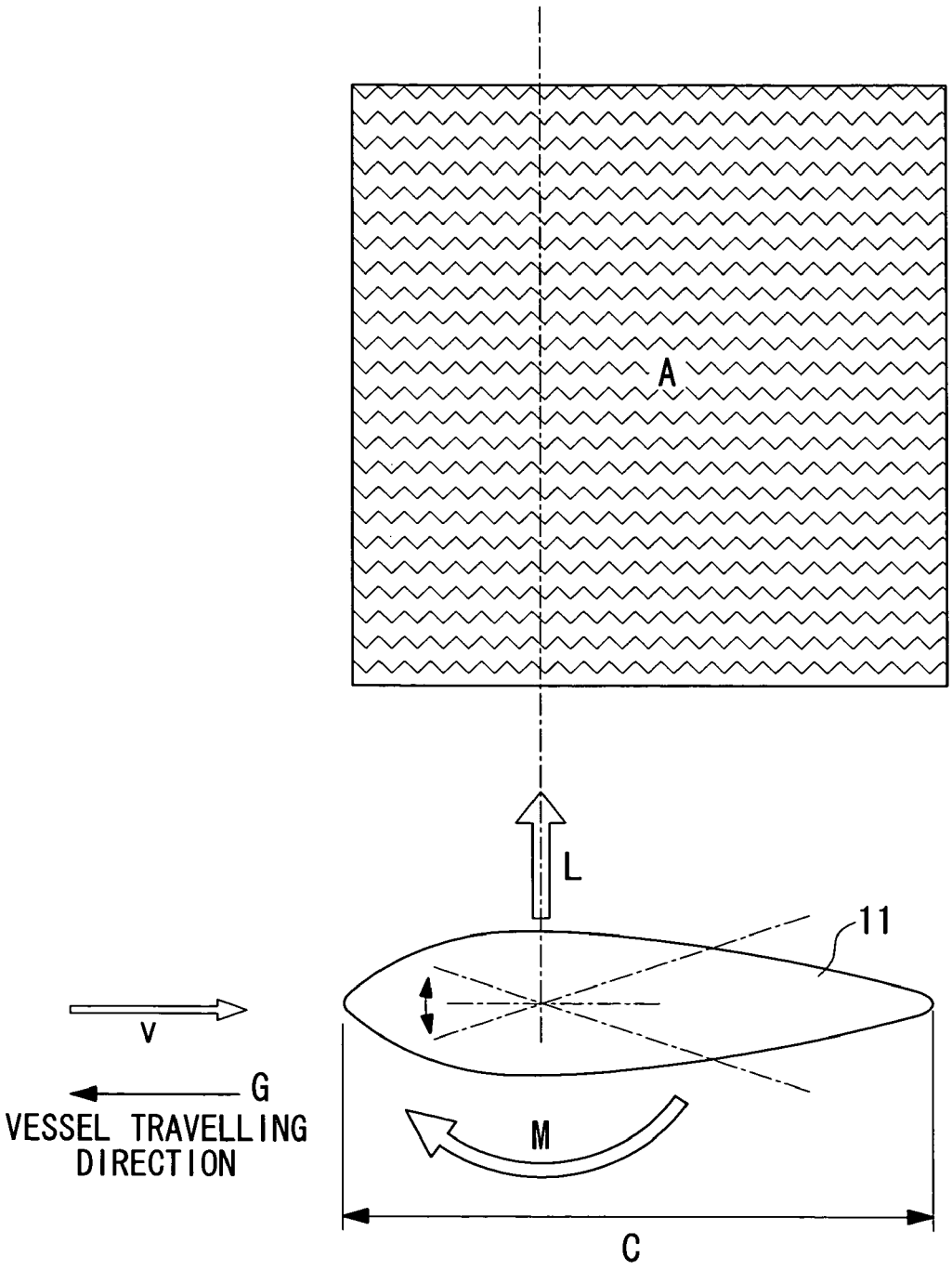
FIG. 5 is an explanatory diagram for explaining parameters used in a calculation expression of the moment coefficient.

Here, various kinds of parameters used in the above expression (1) are described, with reference to FIG. 5. FIG. 5 is a diagram, which shows a vertical sectional view of the fin 11, for explaining a force that acts on the fin 11. In this diagram, the arrow G denotes a traveling direction of the vessel body 2.

In the above expression (1), the parameter M is a moment that acts on the fin 11 as shown in FIG. 5. In the present embodiment, a torque of the fin 11 inputted to the angle of attack computing unit 24 is employed as the moment M. Moreover, the parameter ρ represents the density of the sea water. For example, 1025 kg/m$^3$ is used for this. The parameter v is the flow velocity of the sea water. In the present embodiment, the vessel speed is used for this. The direction of the flow velocity of the sea water and the direction of the vessel velocity are opposite as shown in FIG. 5. The parameter A denotes a surface area of the fin 11. For example, an example of the surface area is shown as a square in the upper section of FIG. 5. The parameter C denotes a length of the fin 11 in the direction of sea water flow. Among the above various kinds of parameters, the parameters ρ, A, and C are pre-recorded as constant values, and the parameters v and M are values that reflect the speed and torque of the vessel in real time.

The angle of attack computing unit 24, on input of a torque from the torque adjusting unit 28, inputs this torque into the above expression (1) as the parameter M, and inputs the vessel speed v at this point in time into the above expression (1), and calculates the moment coefficient Cm. Subsequently, the angle of attack computing unit 24 obtains the angle of attack θ2 corresponding to this moment coefficient Cm and vessel speed v from the moment coefficient table shown in FIG. 4. Thus, when the angle of attack θ2 of the fin 11 has been obtained, the angle of attack computing unit 24 outputs the angle of attack θ2 as an estimated angle of attack, that is, an estimated angle of attack θ2'.

Then this estimated angle of attack θ2' is fed back to the command control section 23 shown in FIG. 3.

Subsequently, the command generation section 23 calculates the fin angle command value θ3 for matching the estimated angle of attack θ2', which is fed back from the angle of attack computing unit 24, with the target fin angle θ1 inputted from the fuzzy computing unit 21. By outputting this fin angle command value to the flow rate adjusting mechanism 14, the fin angle is adjusted based on the fin angle command value θ3. As a result, it becomes possible to match the actual angle of attack θ2 of the fin 11 with the target fin angle θ1. Accordingly, a required lifting force F can be generated due to the effect of the fin, and it becomes possible to suppress the rocking motion of the vessel body 2.

As described above, according to the fin stabilizer according to the present embodiment, the fin angle after various kinds of disturbances W such as currents have acted, that is, the angle of attack, is estimated, and then feedback control for the fin angle is carried out based on this estimated angle of attack θ2'. Therefore a reduction in lifting force due to the disturbance W can be eliminated and the accuracy of the anti-rolling control can be improved.

Second Embodiment

Figure 6:
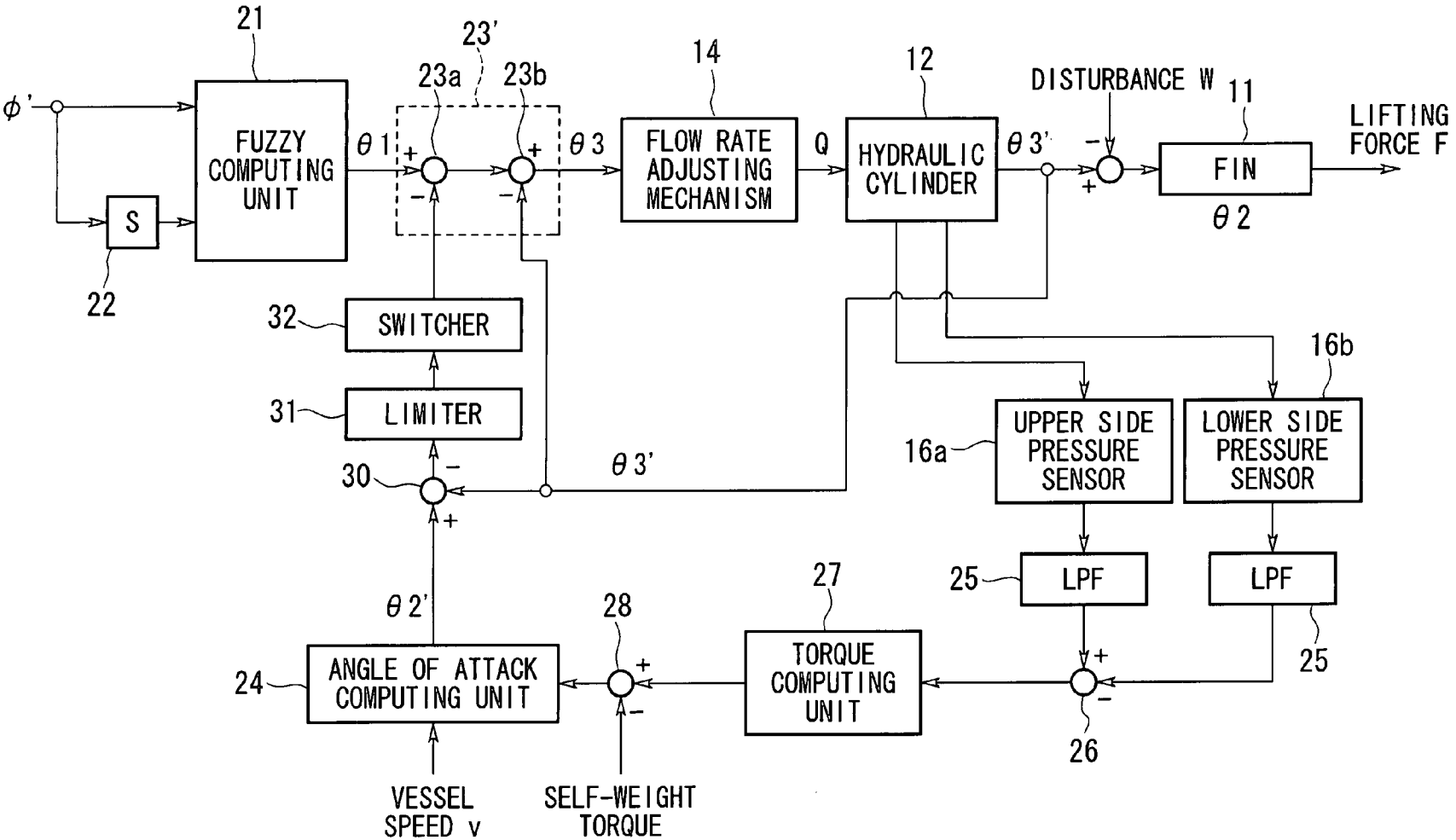
FIG. 6 is a block diagram showing a control system of a fin stabilizer according to a second embodiment of the present invention.

Next, a second embodiment of the present invention is described, with reference to FIG. 6.

A fin stabilizer of the present embodiment differs from that of the first embodiment in that in the feed back system, a predetermined condition is added, and the fin angle to be fed back is switched between either the estimated angle of attack θ2' or the actual fin angle θ3' according to this condition.

For the fin stabilizer according to the present embodiment, in the case where, for example, a difference between the estimated angle θ2' and the actual fin angle θ3' is less than or equal to a predetermined value (for example, 2°) and a rocking motion cycle of the vessel body 2 (refer to FIG. 1) is greater than or equal to a preset predetermined threshold value (for example, 20 seconds), the estimated angle of attack θ2' is fed back.

Conversely, in the case where the above condition is not satisfied, that is, in the case where the difference between the estimated angle of attack θ2' and the actual fin angle θ3' exceeds the predetermined value (for example, 2°) or in the case where the rocking motion cycle of the vessel body 2 (refer to FIG. 1) is less than or equal to the preset predetermined threshold value (for example, 20 seconds), the actual fin angle θ3' is fed back to the fin stabilizer instead of the estimated angle of attack.

For example, in the case where the rocking motion cycle of the vessel body is short, it becomes difficult to remove a higher harmonic wave contained in the sensor output from each of the pressure sensors 16*a* and 16*b* using the low-pass filter 25. Consequently, in the present embodiment, for the range within which pressures in the upper and lower cylinder chambers of the hydraulic cylinder cannot be detected at a high level of accuracy, feed back control is carried out based on the actual fin angle θ3' and not on the estimated angle of attack θ2'. Therefore, for example, the predetermined threshold value under the above condition is determined by the performance of the low-pass filter.

Moreover, in the case where the estimated angle of attack θ2' is significantly different from the actual fin angle θ3', there is a possibility of a malfunction of the pressure sensor. Furthermore, since there is a possibility of a reduction in control stability, then in the present embodiment control stability is maintained by feeding back the estimated angle of attack θ2' only when the difference between both of these angles is within a range of a predetermined value.

Next, an example of a specific configuration of the fin stabilizer for a vessel according to the present embodiment is described with reference to the diagrams. FIG. 6 is a diagram showing a control system of the fin stabilizer according to the present embodiment. In FIG. 6, components the same as those shown in FIG. 3 are denoted by the same reference symbols, and description thereof is omitted.

In the fin stabilizer according to the present embodiment, as shown in FIG. 6, a subtracter 30, a limiter 31, and a switcher 32 are provided on a feedback line that connects the angle of attack computing unit 24 to the command generation section 23'.

First, the estimated angle of attack θ2' estimated by the angle of attack computing unit 24 is inputted to the subtracter 30. The subtracter 30 calculates the difference between the estimated angle of attack θ2' and the actual fin angle θ3'. The actual fin angle θ3' is that detected by a commonly known technique, and the actual fin angle θ3' detected by the commonly known technique may be used.

A difference θ2'−θ3' calculated by the subtracter 30 is inputted to the limiter 31. The limiter 31 performs comparison and determines whether or not the difference θ2'−θ3' is less than or equal to a predetermined value (for example, 2°). If the difference is less than or equal to the predetermined value, then the limiter 31 outputs the difference to the switcher 32, and if the difference exceeds the predetermined value, it outputs "zero" to the switcher 32.

To continue, the switcher 32 is a switch that switches in response to the rocking motion cycle of the vessel body 2. In the case where the rocking motion cycle of the vessel body 2 exceeds the predetermined threshold value, the switcher 32 outputs the difference inputted from the limiter 31 to a first subtracter 23*a* provided for the command generation section 23'. Conversely, in the case where the rocking motion cycle of the vessel body 2 is less than or equal to the predetermined threshold value, the switcher 32 outputs "zero" to the first subtracter 23*a* of the command generation section 23'.

As a result, in the case where the difference between the estimated angle of attack θ2' and the actual fin angle θ3' is less than or equal to the predetermined value (for example 2°) and the rocking motion cycle of the vessel body 2 is greater than or equal to the threshold value, the difference θ2'−θ3' calculated by the subtracter 30 is fed back from the switcher 32 to the first subtracter 23*a* of the command generation section 23'. The first subtracter 23*a* of the command generation section 23' calculates the difference θ1−(θ2'−θ3') between the difference θ2'−θ3' inputted from the switcher 32 and the target fin angle θ1 inputted from the fuzzy computing unit 21, and outputs this calculation result to a second subtracter 23*b* provided for the command generation section 23'. The second subtracter 23*b* calculates the difference between the difference θ1−(θ2'−θ3') inputted from the first subtracter 23*a* and the actual fin angle θ3', that is, θ1−(θ2'−θ3')−θ3'=θ1−θ2', and outputs this calculation result θ1−θ2' as a fin angle command value θ3 to the flow rate adjusting mechanism 14. That is to say, in this case the fin angle to be fed back becomes equal to the estimated angle of attack θ2'.

On the other hand, in the case where the difference between the estimated angle of attack θ2' and the actual fin angle θ3' is greater than the predetermined value (for example, 2°), or in the case where the rocking motion cycle of the vessel body 2 is less than the threshold value, the signal to be fed back to the first subtracter 23*a* of the command generation section 23' becomes "zero". Accordingly, the calculation result of the first subtracter 23*a* of the command generation section 23' becomes θ1−0=θ1, and the target fin angle θ1 is inputted to the second subtracter 23*b*. The second subtracter 23*b* calculates the difference between the target fin angle θ1 and the actual fin angle θ3', that is, θ1−θ3', and outputs this calculation result θ1−θ3' as the fin angle command value θ3 to the flow rate adjusting mechanism 14. That is to say, in this case, the fin angle to be fed back becomes equal to the actual fin angle θ3'.

Accordingly, in the case where the difference between the estimated angle of attack θ2' and the actual fin angle θ3' is less than or equal to the predetermined value (for example, 2°) and the rocking motion cycle of the vessel body 2 (refer to FIG. 1) is greater than or equal to a preset predetermined value, fin angle control is carried out based on the estimated angle of attack θ2'. On the other hand, in the case where the difference between the estimated angle of attack θ2' and the actual fin angle θ3' exceeds the predetermined value, or where the rocking motion cycle of the vessel body 2 is less than the predetermined threshold value, fin angle control is carried out based on the actual fin angle θ3'.

As described above, according to the fin stabilizer according to the present embodiment, in the case where the rocking motion cycle is less than or equal to a predetermined cycle and pressures in the upper and lower cylinder chambers of the hydraulic cylinder 12 cannot be detected at a high level of accuracy, anti-rolling control is carried out based on the actual fin angle θ3', enabling the level of accuracy to be maintained substantially equal to that of the conventional fin stabilizer. Furthermore, in the case where the difference between the actual fin angle θ3' and the estimated angle of attack θ2' is less than or equal to the predetermined value, control can be stabilized since anti-rolling control is carried out based on the actual fin angle θ3'.

The fin stabilizer according to the above first embodiment and second embodiment may have an internal computer system. Furthermore, the series of processing steps relating to the above described stabilizer control may be stored on a computer-readable recording medium in a computer program format, and the above processing may be performed by loading this program onto a computer and executing it.

Specifically, each of the computing sections in the fin stabilizer control system may be realized by having a central processing device such as a CPU load the above program on a main memory device such as a ROM or RAM, to execute information processing or computing processing.

Here a computer-readable recording medium refers to media such as a magnetic disk, an optical magnetic disk, a CD-ROM, a DVD-ROM, or a semiconductor memory.

The embodiments of the present invention have been described in detail with reference to the drawings. However, its specific configuration is not limited to these embodiments, and it includes design modifications that do not depart from the scope of the present invention.

For example, in the above first embodiment, the angle of attack is estimated based on the moment coefficient table shown in FIG. 4. However, this is not limited to this example and the angle of attack may be derived using an operational expression for example. Moreover, as shown in FIG. 4, for example, the angle of attack has a proportional relationship to the moment coefficient, where the moment coefficient is less than or equal to a predetermined value. Therefore, in the case where the moment coefficient is less than or equal to the predetermined value, the angle of attack may be easily calculated based on an operational expression, that is, by multiplying the moment coefficient by a predetermined coefficient. Moreover, in the case where the moment coefficient exceeds the predetermined value, a corresponding angle of attack may be found based on a moment coefficient table such as the one shown in FIG. 4.

What is claimed is:

1. A fin stabilizer for a vessel comprising a fin attached to a vessel body for reducing a rocking motion of the vessel body, and a fin driving device having a hydraulic cylinder for adjusting an angle of the fin with respect to the vessel body, wherein the fin stabilizer comprises:

a pressure detection section that detects a pressure in the hydraulic cylinder;

a torque calculation section that calculates a torque of the fin;

a fin angle estimation section that estimates an angle of the fin with respect to a flow of sea water based on the calculated torque; and a command generation section that generates a fin angle command value for matching the estimated fin angle with a target angle for counteracting the rocking motion of the vessel body, and the fin driving device drives the fin based on the fin angle command value.

2. A fin stabilizer according to claim 1, further comprising a fin angle detection section that detects an angle of the fin with respect to the vessel body, and in the case where a rocking motion cycle of the vessel body is less than or equal to a preset predetermined threshold value, the command generation section generate a fin angle command value for matching the fin angle detected by the fin angle detection section with the target angle.

3. A fin stabilizer according to claim 2, wherein the pressure detection section comprises:

a pressure sensor that respectively detects pressures in an upper cylinder chamber and a lower cylinder chamber of the hydraulic cylinder; and a noise removal section that removes a noise component contained in a detection value detected by the pressure sensor, and the predetermined threshold value is determined based on the performance of the noise removal section.

4. A fin stabilizer according to claim 1 further comprising:

a fin angle detection section that detects an angle of the fin with respect to the vessel body; and a difference calculation section that finds a difference between an angle of the fin with respect to a sea water flow estimated by the fin angle estimation section and an angle of the fin with respect to the vessel body detected by the fin angle detection section, and in a case where the difference is greater than or equal to a preset predetermined value, the command generation section generates a fin angle command value for matching the fin angle with respect to the vessel body detected by the fin angle detection section, with the target angle.

5. A control method for a fin stabilizer for a vessel that comprises a fin attached to a vessel body for reducing a rocking motion of the vessel body, and a fin driving device having a hydraulic cylinder for adjusting an angle of the fin with respect to the vessel body, wherein the control method comprises:

a step for calculating a torque of the fin based on a pressure of the hydraulic cylinder;

a step for estimating an angle of the fin with respect to a flow of sea water based on the calculated torque;

a step for generating a fin angle command value for matching the estimated fin angle with a target angle for counteracting the rocking motion of the vessel body; and a step for controlling the fin driving device based on the fin angle command value.

6. A control program for a fin stabilizer for a vessel that comprises a fin attached to a vessel body for reducing a rocking motion of the vessel body, and a fin driving device having a hydraulic cylinder for adjusting an angle of the fin with respect to the vessel body, for executing on a computer:

a step for calculating a torque of the fin based on a pressure of the hydraulic cylinder;

a step for estimating an angle of the fin with respect to a flow of sea water based on the calculated torque;

a step for generating a fin angle command value for matching the estimated fin angle with a target angle for counteracting the rocking motion of the vessel body; and a step for controlling the fin driving device based on the fin angle command value.

* * * * *